US011841196B2

(12) United States Patent
Nielsen

(10) Patent No.: US 11,841,196 B2
(45) Date of Patent: Dec. 12, 2023

(54) HEAT EXCHANGER WITH A FRAME PLATE HAVING A LINING

(71) Applicant: Danfoss A/S, Nordborg (DK)

(72) Inventor: Helge Nielsen, Sydals (DK)

(73) Assignee: Danfoss A/S, Nordborg (DK)

( * ) Notice: Subject to any disclaimer, the term of this patent is extended or adjusted under 35 U.S.C. 154(b) by 171 days.

(21) Appl. No.: 17/078,213

(22) Filed: Oct. 23, 2020

(65) Prior Publication Data

US 2021/0123692 A1 Apr. 29, 2021

(30) Foreign Application Priority Data

Oct. 25, 2019 (DK) ..... PA201901254

(51) Int. Cl.
*F28F 3/08* (2006.01)
*F28D 9/00* (2006.01)
*F28F 3/10* (2006.01)

(52) U.S. Cl.
CPC ..... *F28F 3/083* (2013.01); *F28D 9/005* (2013.01); *F28F 3/10* (2013.01); *F28F 2280/04* (2013.01)

(58) Field of Classification Search
CPC ..... F28D 9/005; F28D 9/0043; F28F 3/10; F28F 2280/06; F28F 9/0248; F16L 23/028; F16L 23/0283; F16L 23/0286; F16J 15/122; F16J 15/123
See application file for complete search history.

(56) References Cited

U.S. PATENT DOCUMENTS 4,482,089 A * 11/1984 Lindahl ..... B23K 9/0026 29/523
4,595,208 A * 6/1986 Jonsson ..... F28F 19/04 277/650
4,699,212 A * 10/1987 Andersson ..... F28F 19/06 29/523
4,750,555 A * 6/1988 Ahl ..... F28F 3/00 165/DIG. 356
4,872,578 A 10/1989 Fuerschbach et al.
(Continued)

FOREIGN PATENT DOCUMENTS

CN 102187174 A 9/2011
CN 103620334 A 3/2014
(Continued)

OTHER PUBLICATIONS

Extended European Search Report for European Patent Application No. 20200596 dated Feb. 5, 2021.
(Continued)

*Primary Examiner* — Jianying C Atkisson
*Assistant Examiner* — For K Ling
(74) *Attorney, Agent, or Firm* — McCormick, Paulding & Huber PLLC

(57) ABSTRACT

Lining to be positioned in a frame plate of heat exchanger comprising a stack of heat transfer plates, where the lining comprises a tubular part with a first end formed with a first flange and second flange positioned at a distance to the second end, where the second flange is adapted to form a platform to accommodate a sealing element is positioned on the platform of the second flange and this confined between the edge of the recess, the second flange and the outer section and the neighbouring heat transfer plate in the stack of heat transfer plates.

10 Claims, 4 Drawing Sheets

(56) References Cited

U.S. PATENT DOCUMENTS

| | | | | |
|---|---|---|---|---|
| 5,033,543 | A * | 7/1991 | Nilsson | F16L 58/04 165/DIG. 356 |
| 2004/0112580 | A1* | 6/2004 | Jonsson | F28F 19/002 165/167 |
| 2006/0170208 | A1* | 8/2006 | Arning | F16L 23/0283 285/56 |
| 2006/0244261 | A1* | 11/2006 | Shah | F16L 19/0286 285/382 |
| 2014/0131020 | A1* | 5/2014 | Blomgren | F28D 9/005 165/166 |
| 2017/0089644 | A1* | 3/2017 | Petersen | F28F 3/083 |

FOREIGN PATENT DOCUMENTS

| | | | | |
|---|---|---|---|---|
| CN | 105466255 | A | 4/2016 | |
| CN | 105805434 | A | 7/2016 | |
| CN | 108139180 | A | 6/2018 | |
| CN | 209354816 | U | 9/2019 | |
| DE | 3328913 | A1 | 2/1985 | |
| DE | 10155806 | A1 * | 7/2003 | F16J 15/122 |
| EA | 000454 | B1 | 8/1999 | |
| EP | 310725 | A1 * | 4/1989 | F16J 15/122 |
| EP | 2 541 181 | A1 | 1/2013 | |
| RU | 2 320 946 | C2 | 3/2008 | |
| RU | 2 469 252 | C1 | 12/2012 | |
| RU | 2 541 061 | C1 | 2/2015 | |
| WO | 86/04406 | A1 | 7/1986 | |

OTHER PUBLICATIONS

Office Action issued for Chinese Patent Application No. 202011042359.7 dated Aug. 24, 2022 and its English translation.

* cited by examiner

HEAT EXCHANGER WITH A FRAME PLATE HAVING A LINING

CROSS-REFERENCE TO RELATED APPLICATION

This application claims foreign priority benefits under 35 U.S.C. § 119 to Danish Patent Application No. PA201901254 filed on Oct. 25, 2019, the content of which is hereby incorporated by reference in its entirety.

BACKGROUND

A typical construction of a plate heat exchanger comprises a plurality of heat transfer plate stacked on top of each other. The heat transfer plates are formed with patterns such that flow paths are formed between each set of neighboring heat transfer plates. Openings are formed in the heat transfer plates defining inlets and outlets for fluids to these flow paths. Some heat exchangers have the plates brazed together, whereas in others heat exchangers gaskets are positioned between the heat transfer plates in gasket grooves formed in the heat transfer plates. The gasket then is arranged at an edge portion of the heat transfer plate to seal the flow paths and at an area around the openings to seal pairs of the openings, such that only two of them have flow access to the flow path formed at one side of the heat transfer plate, while the other two is sealed therefrom.

Frame plates may be connected and fastened to the stack of heat exchangers plates, such as at the top and bottom, and has a significant thickness compared to the heat transfer plates to take up great loads. Where the heat transfer plates normally are formed of materials resistant to the media flow through the heat exchangers, such as stainless steel, titanium etc., this would be expensive for the relative thick frame plates. Except from the openings the frame plates usually are sealed from the flowing media, and therefore in these linings may be inserted.

The problem with many prior designs of such linings is they often requires several different elements in the construction, and often need to be specially designed to the relevant heat transfer plates, frame plates etc. The object of the present invention therefore is to simplify the linings and to make them more versatile such that the same linings can be used at different heat transfer plate designs etc.

SUMMARY

The present invention solves the problems by introducing a lining as it is described in the claims.

This include introducing a lining to be positioned in a frame plate of heat exchanger, said heat exchanger comprising a stack of heat transfer plates each positioned in parallel to the frame plate, said lining comprising a tubular part with a first end formed with a first flange, characterized in that a second flange is positioned at a distance to the second end, thus dividing the tubular part into a middle section and an outer section, where the middle section is formed between the first flange and second flange wherein the second flange and outer section together forms a platform to accommodate a sealing element to be positioned between second flange and the neighbouring heat transfer plate in the stack of heat transfer plates to the frame plate.

The first and second flanges thus extend in parallel to the frame plate and the heat transfer plates.

The neighbouring heat transfer plate is the one in the stack being in contact to the frame plate.

The frame plate may in its inner surface be formed with a recess encircling the opening, and borders the opening encircling the opening, where the first flange is adapted to be positioned with the 'inner' surface forming a first flange contact section to the outer surface of the frame plate, and where the recess is adapted to accommodate the second flange, such that the inner surface of the second flange forms a contact to the surface of the recess.

A sealing element may be adapted to be positioned on the second flange being confined between the edge of the recess, or just the inside surface of the frame plate, the second flange and the outer section and the neighbouring heat transfer plate in the stack of heat transfer plates.

In an embodiment the neighbouring heat transfer plate is formed with a projection forming the contact to the sealing element, where the projection may only contacts part of the surface of the sealing element.

The outer section may be formed when connecting the second flange to the tubular part, e.g. by brazing or welding.

The outer section and second flange may be formed by bending the outer section of the tubular part.

The tubular part may be formed of two individual sections, one including the second flange and one including the first flange, and where these are adapted to be introduced into the frame plate opening from each side of the frame plate. The two sections of the tubular part may overlap within the frame plate opening being connected simply by pressing against each other and the inner frame plate opening wall.

DETAILED DESCRIPTION

It should be understood, that the detailed description and specific examples, while indicating embodiments of the invention, are given by way of illustration only, since various changes and modifications within the spirit and scope of the invention will become apparent to those skilled in the art from the detailed description.

Figure 1:
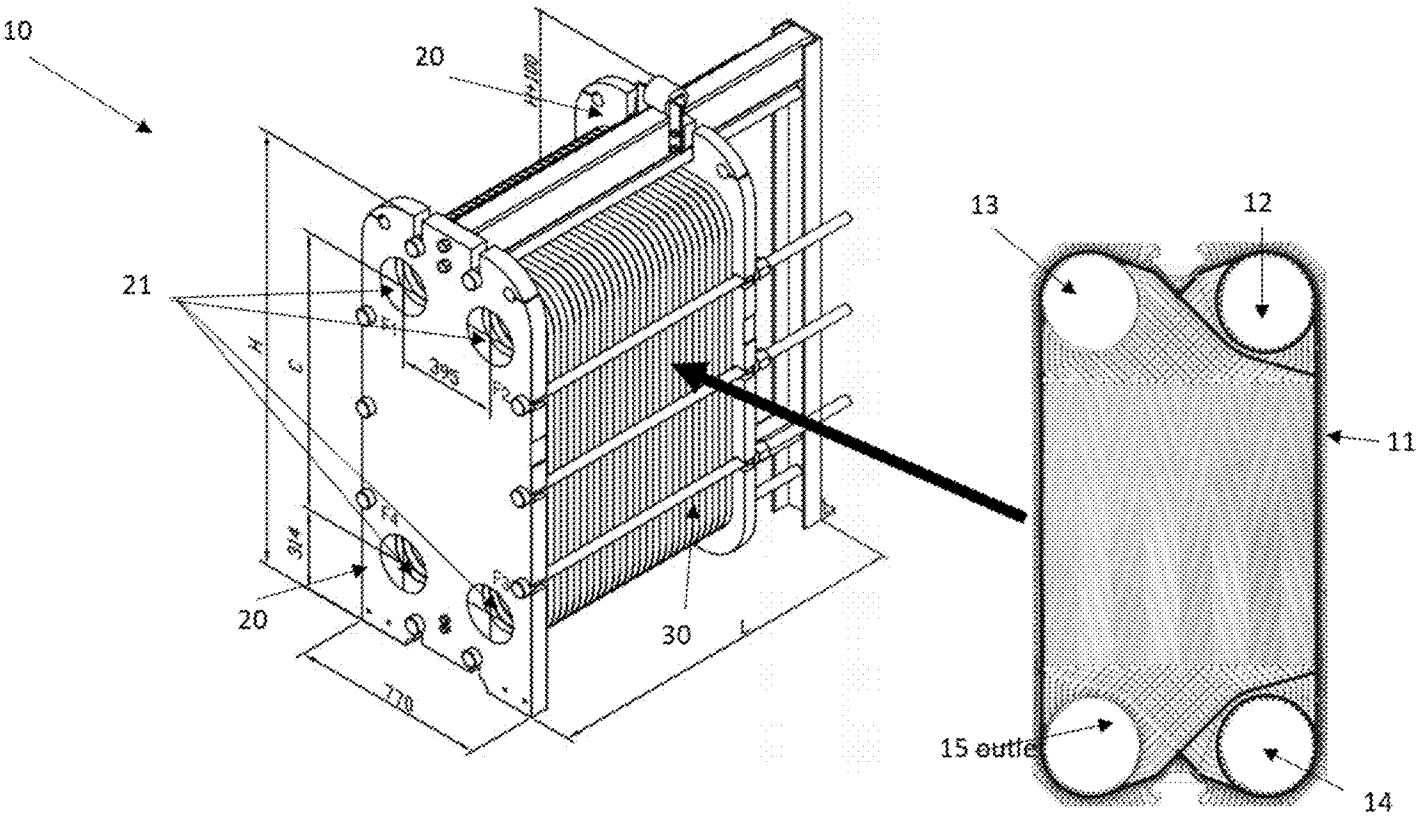
FIG. 1 General presentation of an embodiment plate heat exchanger of the present invention.

FIG. 1 shows one example of a plate heat exchanger (10) formed of a collection, or stack, of structured heat transfer plates (11). Each of the heat transfer plates (11) is provided with four openings forming two inlet (12, 13) and two outlet (14, 15) channels through the plate stack. In the illustrated example the heat transfer plates (11) at a rim portion is adapted to accommodate a gasket to respectively seal the flow paths formed between each two neighbouring plates (11) from the externals, and to seal a set of respectively an inlet (12) and outlet (14) opening—where at the opposite side of the plate (11) the respective other inlet (13) and outlet (15) is sealed. Further the plate stack is arranged between two frame plates (20) being held together by bars (30) keeping the heat transfer plates (11) tight together under compression. At least one of the frame plates (20) include openings (21) aligned to the heat transfer plate openings (12, 13, 14, 15) and to be connected to external fluid pipes.

The heat transfer plates (11) being in direct contact with the fluids usually is substantially thin to enable a fast exchange of heat between respectively a hot and cold fluid and are made of materials resistant to the media.

The frame plates (20) is relatively thick compared to the heat transfer plates (11) to withstand both the internal forces from the compressed stack of heat transfer plates (11), and what external impacts they may encounter. To keep cost down, they usually are made of cheaper materials not necessarily suitable for the fluids.

Figure 2:
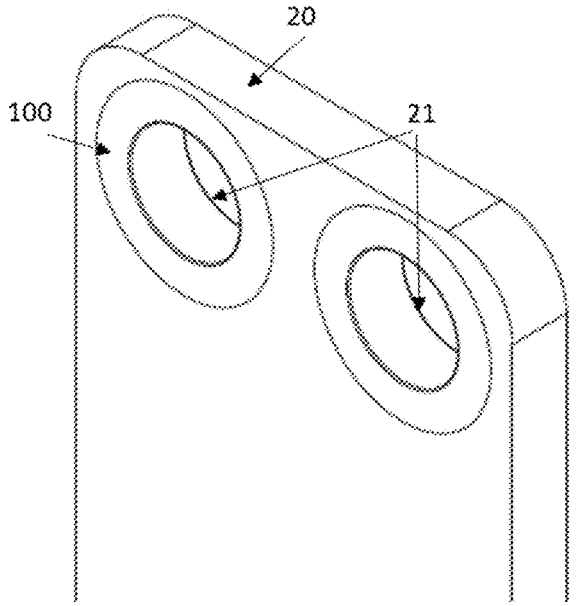
FIG. 2 Illustration of a section of a frame plate with linings inserted in the frame plate openings.

Linings (100) therefore are inserted in the frame plate openings (21) (FIG. 2) to protect the frame plates (20) from the fluids, where these can be relatively thin and formed of materials resistant to the fluids, e.g. the same as the heat transfer plates (11).

Figure 3:
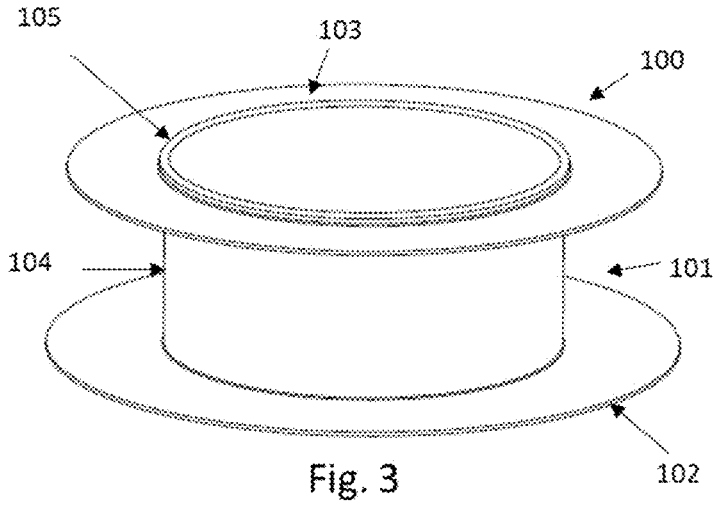
FIG. 3 Illustration of a lining according to the present invention.

FIG. 3 illustrate an embodiment lining (100) according to the present invention. The lining (100) is formed of a tubular part (101) adapted to fit in the frame plate openings (20). The first end of the tubular part (101) is formed with a first flange (102), and a second flange (103) is positioned at a distance to the second end, thus dividing the tubular part (101) into a middle section (104) and an outer section (105), where the middle section (104) is formed between the first flange (102) and second flange (103).

The second flange (103) and outer section (105) together forms a platform to accommodate a sealing, or gasket, element (200) and is adapted to have the inner surface of the second flange (103) (facing towards the first flange (102)) positioned in connection with the frame plate (20), and the respective outer surface positioned such that the sealing element (200) is sandwiched between the outer surface and the neighbouring heat transfer plate (11). The second flange (103) inner surface thus forming contact (103*a*) to the frame plate (20).

Figure 4:
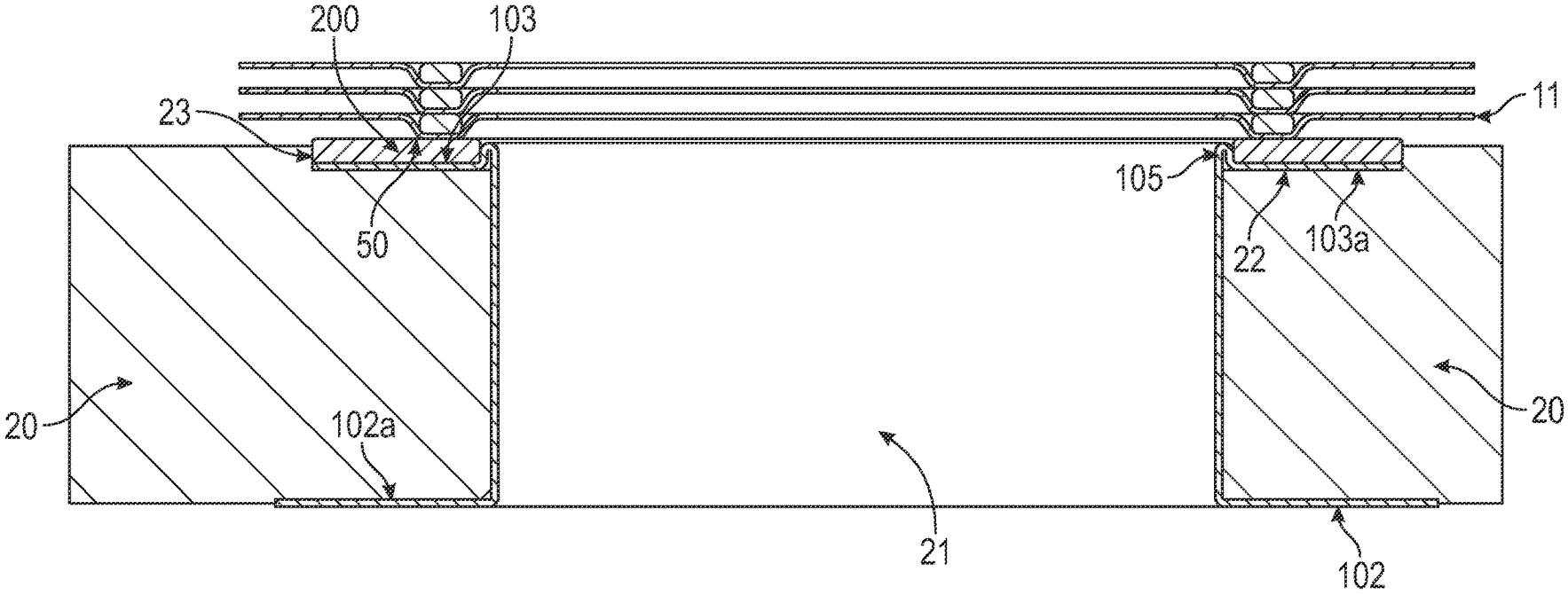
FIG. 4 Side view of a frame plate opening with an inserted lining and a sealing element contacting the neighbouring plate.
Figure 5B:
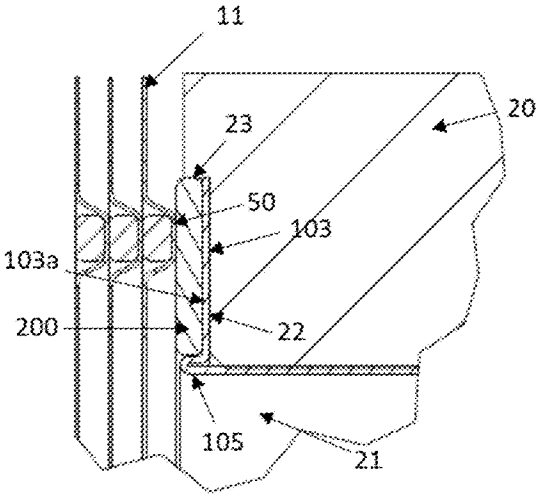
FIGS. 5A, 5B Side views of a frame plate opening with an inserted lining and a sealing element contacting the neighbouring plate at two different locations.
Figure 5A:
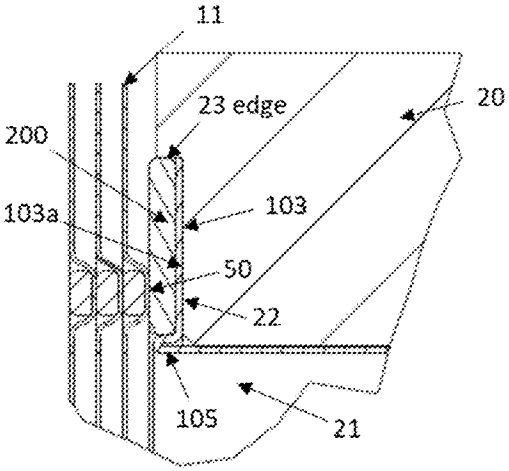

The sealing element (200) thus is adapted to face the neighbouring heat transfer plate (11) directly In one embodiment the outer section (105) is formed when connecting the second flange (103) to the tubular part (101), e.g. by brazing or welding. In an alternative embodiment as also illustrated in FIGS. 4, 5A and 5B the outer section (105) and second flange (103) is formed by bending the outer section of the tubular part (101). In this embodiment, or any of the others, the tubular part (101) may be formed of two individual sections, one including the second flange (103) and one including the first flange (102), and where these are introduced into the frame plate opening (21) from each side of the frame plate (20). In one embodiment the two sections of the tubular part (101) overlaps within the frame plate opening (21) being connected simply by pressing against each other and the inner frame plate opening (21) wall.

FIG. 4 illustrate a side view section of a frame plate (20) with opening (21) with a lining (100) inserted. The first flange (102) is positioned with the 'inner' surface forming a first flange contact (102*a*) section to the outer surface of the frame plate (20). The frame plate (20) in its inner surface is formed with a recess (22) encircling the opening, and borders the opening (21), which in the illustrated embodiment encircles and borders the opening (21). Alternatively, it could also encircle the opening (21) at a distance.

The recess (22) is adapted to accommodate the second flange (103), such that the inner surface of the second flange (103) forms a contact (103*a*) to the surface of the recess (22).

In the embodiment where the recess (22) encircles the opening (21) at a distance, the second flange (103) would be shaped accordingly with an 'inner' section reaching over the edge part of the frame opening (21) and a contact (103*a*) part bending to reach into the recess (22).

When installed, the sealing element (200) is positioned on the platform of the second flange (103) and this confined between the edge (23) of the recess (22), the second flange (103) and the outer section (105) and the neighbouring heat transfer plate (11) in the stack. The sealing element (200) therefore is facing the heat transfer plate (11) directly.

The sealing element (200) ensures a leak tight attachment of the lining (100) in the frame opening (21) in the sense fluids are sealed from the inside of the heat exchanger (10) (the flow paths formed between the stack of heat transfer plates (11)), and the area between the inner surface of the frame opening (21) and the outer surface of the lining (100) middle section (104).

The thickness of the sealing element (200) in an embodiment is larger than the height of the edge (23), corresponding to the depth of the recess (2), and the neighbouring the sealing element (200) therefore is heat transfer plate (11) therefore squeezes the sealing element (200). This has plural effects. One is the connection of the second flange (103) and the neighbouring heat transfer plate (11) to the sealing element (200) is tight, event at some deformation of the neighbouring heat transfer plate (11). Another is the sealing (200) is kept in position by the friction, enabling e.g. the sealing element (200) to have a smaller cross area thickness than the length of the recess (22). This enables the use of standardized sealing elements (200) in a variety of different heat exchangers (10), where they may not fit quite to the frame opening (21).

In one embodiment the gasket comprises a corrugated or 'dimpled' pattern on one or both surfaces facing the neighbouring heat transfer plate (11) or second flange (103).

In an embodiment the neighbouring heat transfer plate (11) is formed with a projection (50) forming the contact to the sealing element (200), where this projection only contacts part of the surface of the sealing element (200). This could be such that the projection encircles the respective inlet or outlet opening (12, 13, 14, 15)—possible at a distance—thus contacting the sealing element (200) at the full circumference, but has a top width only contacting part of the width of the sealing element (200), thus squeezing into this. In one embodiment the projection (50) has a pointed contact, in another a flat contact part. In on embodiment the contacting surface of the sealing element (200) is formed with a recess matching the projection (50) or being slightly smaller ensuring the projection still squeezes into the sealing element (200). In an embodiment the projection (50) is a projection adapted to accommodate a gasket element at the opposite side, as also seen in the figure.

It should be indicated, that though the lining (100) is indicated to have tubular parts (101, 104, 105), it could have non-circular cross sections to match the form of the frame opening (21).

FIGS. 5A and 5B shows a section of the frame plate opening (21) where the contacting projection (50) of the neighbouring plate (11) contact the sealing element (200) at two different locations, thus showing an advantage of the present invention.

While the present disclosure has been illustrated and described with respect to a particular embodiment thereof, it should be appreciated by those of ordinary skill in the art that various modifications to this disclosure may be made without departing from the spirit and scope of the present disclosure.

What is claimed is:

1. A heat exchanger with a frame plate having a lining, said heat exchanger comprising a stack of heat transfer plates each positioned in parallel to the frame plate, said lining comprising a tubular part with a first end formed with a first flange, wherein a second flange is positioned at a distance to a second end, thus dividing the tubular part into a middle section and an outer section, where the middle section is formed between the first flange and second flange, wherein the second flange and outer section together forms a platform to accommodate a sealing element to be positioned between the second flange and the neighbouring heat transfer plate in the stack of heat transfer plates to the frame plate, wherein the sealing element has a thickness that is larger than a depth of a recess, and wherein the heat transfer plate directly contacts and squeezes the sealing element.

2. The heat exchanger according to claim 1, wherein the lining is adapted to be positioned in connection to the frame plate, such that an inner surface of the frame plate is formed with the recess encircling and bordering an opening, where the first flange is positioned with an inner surface of the first flange forming a first flange contact section to an outer surface of the frame plate, and where the recess is adapted to accommodate the second flange, such that an inner surface of the second flange forms a contact to a surface of the recess.

3. The heat exchanger according to claim 2, where the sealing element is adapted to be positioned on the second flange being confined between an edge of the recess and the outer section, and between the second flange and the neighbouring heat transfer plate in the stack of heat transfer plates.

4. The heat exchanger according to claim 2, wherein the neighbouring heat transfer plate is formed with a projection forming the contact to the sealing element.

5. The heat exchanger according to claim 4, where the projection only contacts part of the surface of the sealing element that faces the neighbouring heat transfer plate.

6. The heat exchanger according to claim 1, where the tubular part is formed of two individual sections, one including the second flange and one including the first flange, and where these are adapted to be introduced into the frame plate opening from each side of the frame plate.

7. The heat exchanger according to claim 6, where said two sections of the tubular part is adapted to overlap when positioned within the frame plate opening being connected simply by pressing against each other and an inner frame plate opening wall.

8. The heat exchanger according to claim 2, where the tubular part is formed of two individual sections, one including the second flange and one including the first flange, and where these are adapted to be introduced into the frame plate opening from each side of the frame plate.

9. The heat exchanger according to claim 3, where the tubular part is formed of two individual sections, one including the second flange and one including the first flange, and where these are adapted to be introduced into the frame plate opening from each side of the frame plate.

10. The heat exchanger according to claim 4, where the tubular part is formed of two individual sections, one including the second flange and one including the first flange, and where these are adapted to be introduced into the frame plate opening from each side of the frame plate.

* * * * *